US005918813A

United States Patent [19]

Rucker

[11] Patent Number: 5,918,813

[45] Date of Patent: Jul. 6, 1999

[54] ROTATING SPRAY HEAD

[76] Inventor: David L. Rucker, 412 Indio Dr., Shell Beach, Calif. 93449

[21] Appl. No.: 08/877,141

[22] Filed: Jun. 17, 1997

[51] Int. Cl.[6] ..... B05B 3/06

[52] U.S. Cl. ..... 239/246; 239/251

[58] Field of Search ..... 239/246, 248, 239/249, 251, 259, 261; 134/167 C, 179

[56] References Cited

U.S. PATENT DOCUMENTS

| | | | |
|---|---|---|---|
| 2,880,938 | 4/1959 | Stewart et al. | 134/179 X |
| 3,125,297 | 3/1964 | Copeland | 239/261 |
| 4,030,513 | 6/1977 | McKenzie | 239/251 X |
| 4,697,740 | 10/1987 | Ivy | 239/261 X |
| 5,211,337 | 5/1993 | Lukez | 239/251 |
| 5,316,218 | 5/1994 | Bowen | 239/251 X |
| 5,620,250 | 4/1997 | Chilcoat et al. | 239/261 X |

*Primary Examiner*—Lesley D. Morris

*Attorney, Agent, or Firm*—Townsend and Townsend and Crew LLP

[57] ABSTRACT

A rotating spray head (2) includes a hollow stem (4) to which a body (18) is rotatably mounted. The body has a generally cylindrical outside surface (14) and distal and proximal ends (18,16); the ends have generally U-shaped edges (49). The inlet stem and body define a generally cylindrical reservoir (38) therebetween. A pair of offset side nozzles (42) are formed through the outside surface of the body. End nozzles (48) are formed through each of the U-shaped edges. Liquid flows from the reservoir through the side nozzles along offset flow paths to spin the body and through the end nozzles along flow paths passing generally through the axis. The rotating spray head thus provides a simple, compact spray nozzle which can provide a full 360° spray pattern.

7 Claims, 3 Drawing Sheets

ROTATING SPRAY HEAD

BACKGROUND OF THE INVENTION

Tank cleaning machines are designed to operate under various environments and conditions. Some tank cleaning machines are quite complicated and use impeller-driven gear drives to rotate the spray nozzles over a variety of paths to create complicated spray patterns. For example, see U.S. Pat. No. 4,664,720. Other cleaning situations do not require such complicated and costly tank cleaning machines. For example, U.S. Pat. No. 5,316,218 shows a spray head having a nozzle body mounted to the end of a mounting member. The nozzle body has a generally spherical shape with a pair of slots through which the cleaning liquid is dispensed. The orientation of the slots causes the nozzle body to rotate around the outer end of the mounting member to provide a desired spray pattern.

SUMMARY OF THE INVENTION

The present invention is directed to a spray head which is relatively simple in construction, can be passed through relatively small openings and can be easily adapted to customize the flow volume and spray pattern.

The spray head includes a hollow stem to which a body is rotatably mounted. The body has a generally cylindrical outside surface, a distal end, and a proximal end. Each of the distal and proximal ends preferably has a generally U-shaped edge and a recessed cylindrical stem mounting surface.

The inlet stem and body define a generally cylindrical reservoir therebetween. A flow path extends from the hollow inlet stem, through a fluid passageway in the inlet stem and into the reservoir.

At least one, but preferably a pair of, offset side nozzles are formed through the generally cylindrical outside surface of the body into the reservoir. End nozzles are formed through the edges at the distal and proximal ends of the body into the reservoir. Liquid in the reservoir passes through the side nozzles along flow paths oriented offset to the axis of rotation of the body to cause the body to rotate about the axis. Liquid in the reservoir can also pass through the end nozzles. End nozzles are preferably positioned and oriented to create end flow paths oriented to pass generally through the axis. The rotating spray head thus provides a simple, compact spray nozzle which can provide a full 360° spray pattern.

An advantage of the invention is that the spray pattern and flow rate can be easily chosen by simply modifying the size, number and location of the side and end nozzles formed in the body. Typically, the nozzles can be formed to provide a 360° spray pattern for omnidirectional washing. Also, the nozzles are preferably formed to substantially eliminate undesirable reaction forces, such as by using two or more equally-spaced side spray nozzles.

Another advantage arises from the use of a body having a generally cylindrical outside surface. This enables the spray head to be small in size and fit through relatively small openings.

A further aspect of the invention is the provision of bearings used to mount the body to the inlet stem. In this way the inlet stem and body can be made of appropriate materials, typically a metal such as 316 stainless steel, while the bearing can be made of an appropriate low friction material, such as Lubricomp O-BG, an internally lubricated reinforced thermoplastic, made by LNP Engineering, Inc. of Exton, Pa. Thus, if wear does occur, it will be of the easily replaceable and relatively low cost bearings rather than of the more expensive inlet stem or body.

Another aspect of the invention is its simplicity of assembly. A first or proximal bearing can be mounted over the distal end of the stem and seated at a shoulder; the body is then mounted over the distal end so the cylindrical stem mounting surface engages the first bearing. The second or distal bearing is then mounted to the distal end of the stem end to engage the cylindrical stem mounting surface at the distal end of the body. This assembly is typically held in place by a washer and snap ring arrangement.

If desired, the distal end of the inlet stem could be provided with an axially oriented nozzle to provide axially-oriented spray.

Other features and advantages of the invention will appear from the following description in which the preferred embodiment is set forth in detail in conjunction with the accompanying drawings.

DESCRIPTION OF THE PREFERRED EMBODIMENT

Figure 1:
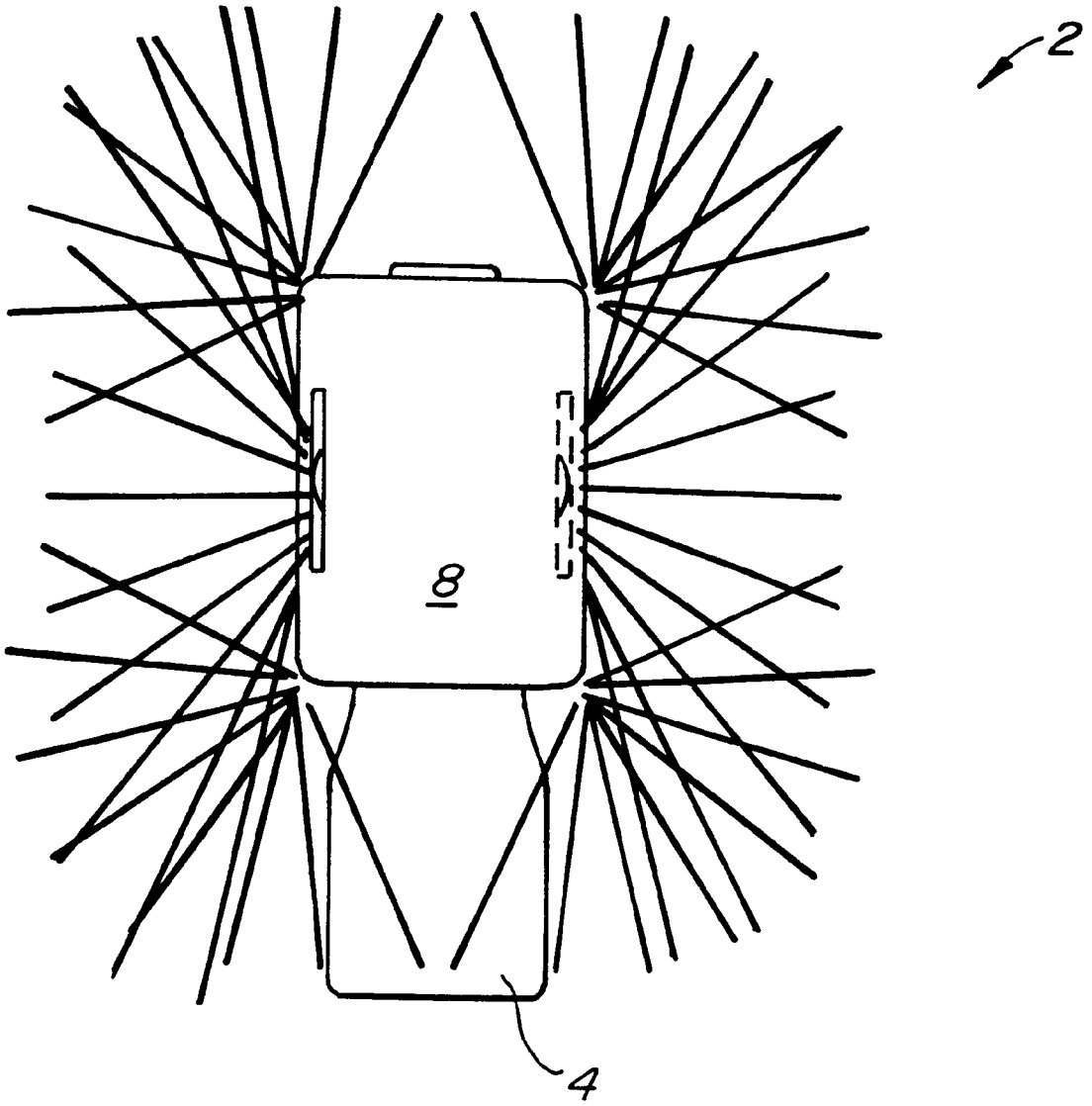
FIG. 1 is a simplified side view showing a spray head made according to the invention illustrating, in graphic form, the general 360° spray pattern produced by the side and end nozzles.
Figure 2:
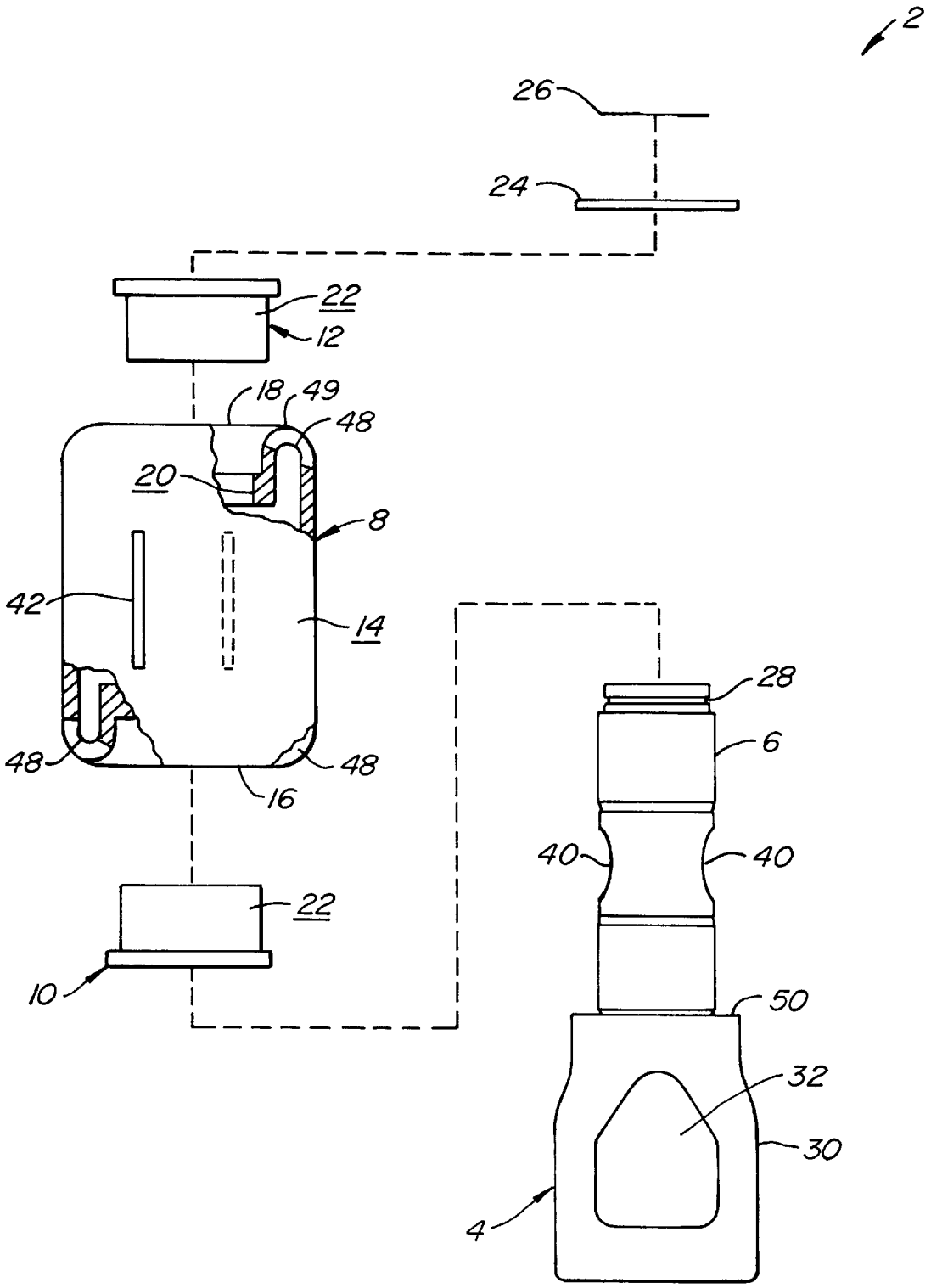
FIG. 2 is an exploded side elevational view of the spray head of FIG. 1.
Figure 4:
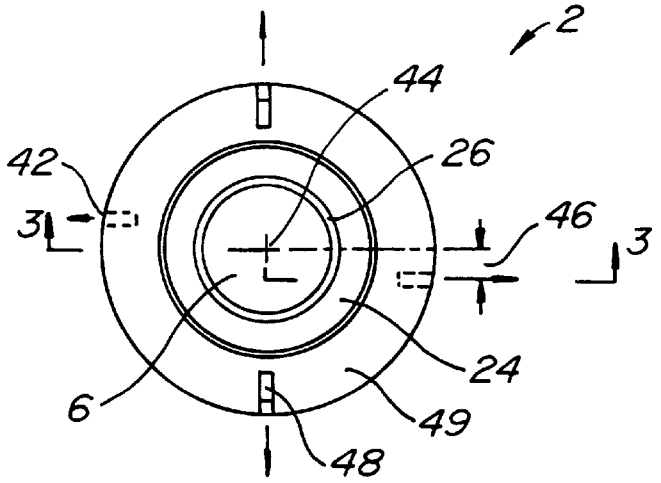
FIG. 4 is an end view of the spray head of FIG. 1.
Figure 3:
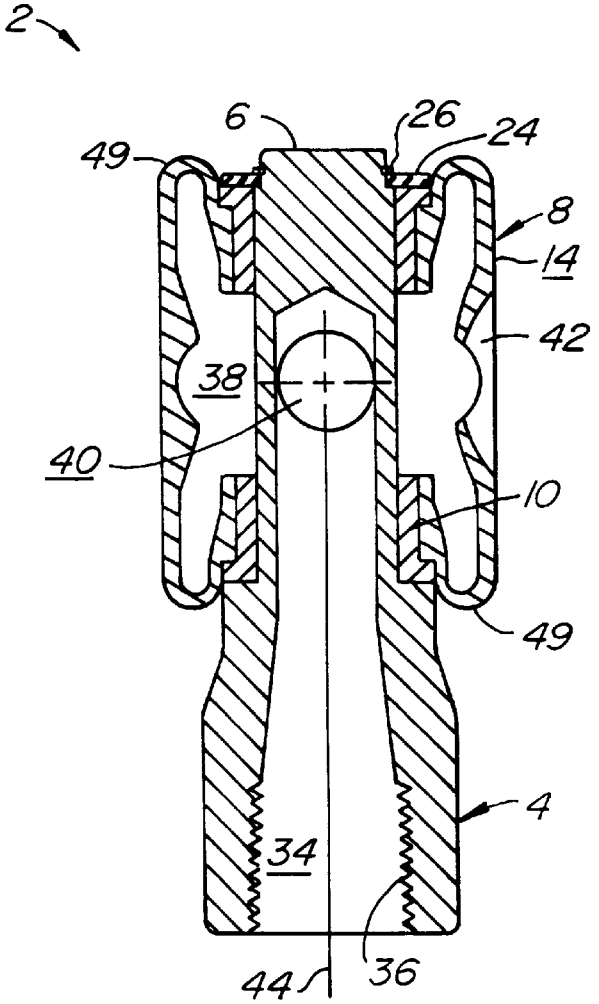
FIG. 3 is an assembled cross-sectional view of the spray head of FIG. 1.

FIGS. 1–4 illustrate a rotating spray head 2 comprising a hollow inlet stem 4 having a distal end 6, to which a body 8 is rotatably mounted by a pair of bearings 10,12. Inlet stem 4 and body 8 are preferably made of 316 stainless steel and bearings 10,12 are preferably made of Lubricomp O-BG; other materials suitable for the environment can also be used. Also, the bearing material, in addition to being low friction, is preferably chosen so that any wear between bearings 10,12 and body 8 and/or inlet stem 4 will be wear to the bearing. This helps to insure that if wear does occur, bearings 10,12 will wear more than the more expensive body 8 and inlet stem 4.

Body 8 has a generally cylindrical outside surface 14, and proximal and distal ends 16,18. Proximal and distal ends 16,18 are generally U-shaped and terminate in cylindrical stem mounting surfaces 20 sized to engage the outer cylindrical surface 22 of bearings 10,12. The assembly of bearings 10,12 with body 8 therebetween is secured in place between a shoulder 50 on stem 4 at one end and a washer 24 and a snap ring 26 at the other end, the snap ring engaging a groove 28 formed in distal end 6 of inlet stem 4.

The hollow interior 34 of inlet stem 4 has pipe threads 36 formed at its proximal end. The proximal end 30 of inlet stem 4 has a pair of flat regions 32 to facilitate mounting spray head 2 to a threaded pipe, not shown.

Distal end 6 of inlet stem 4 and body 8 define a generally cylindrical reservoir 38 therebetween. Reservoir 38 is fluidly coupled to hollow interior 34 by a pair of fluid passageways 40.

Body 8 has a pair of side nozzles 42 formed through its generally cylindrical outside surface 14. Side nozzles 42 are generally parallel to but offset from axis 44 of spray head 2. See also FIG. 4. This offset 46 can be changed to change the torque arm, and thus the speed of rotation of body 8 about distal end 6 of inlet stem 4. In the preferred embodiment, two side nozzles 42 are used, each side nozzle spaced apart from the other by an equal circumferential distance, that is 1800, to ensure that the forces on body 8 are balanced. Other numbers of nozzles 42 could be used, such as three equally spaced side nozzles, each separated by 120° .

Body 8 also has a pair of end nozzles 48 at each of proximal end 16 and distal end 18. As can be seen from FIGS. 2 and 3, proximal and distal ends 16,18 have generally U-shaped edges 49 with the end nozzles 48 shaped as slots formed through the bight of the U. End nozzles 48 are, in this preferred embodiment, positioned to lie parallel to and aligned with axis 44 so the discharge of liquid through nozzles 48 does not create a rotational torque on body 8. Four end nozzles 48 are used in the preferred embodiment, two at each end 16,18 so to balance any reaction forces which may be produced by the discharge of liquids through the nozzles. Other numbers of nozzles, preferably equally spaced about axis 44 can also be used.

Spray head 2 is easily assembled by first mounting bearing 10 onto distal end 6 of inlet stem 4 until the bearing abuts a shoulder 50. Then body 8 is mounted over distal end 6 so that the cylindrical stem mounting surface 20 at proximal end 16 engages the outer cylindrical surface 22 of bearing 10. Next, bearing 12 is mounted over distal end 6 so that its outer surface 22 engages the cylindrical stem mounting surface 20 at distal end 18 of body 8. Finally, washer 24 and snap ring 26 are mounted over distal end 4 until snap ring 26 engages groove 28 formed in the distal end. If a somewhat different washing pattern is desired, one can simply replace body 8 with a different body having somewhat differently sized, positioned or configured side nozzles 48 and/or end nozzles 50 by removing snap ring 26, washer 24, distal bearing 12 and body 8. The replacement body 8 would then be mounted in the same manner as discussed above. Also, if bearings 10,12 become excessively worn, they can easily be replaced in the same manner.

All patents referred to above are incorporated by reference.

Modification and variation can be made to the disclosed embodiment without departing from the subject of the invention as defined in the following claims. For example, the outside diameter of body 8 could be made to be about equal to the outside diameter of proximal end 30 of inlet stem 4 to permit the spray head to enter even smaller-size openings. In such an embodiment, end nozzles 48 at proximal end 16, or both proximal end 16 and distal end 18, could be eliminated. This would provide a lesser spray pattern, such as 175° , from side nozzles 42 alone, rather than the 360° spray pattern from nozzles 42,48 of the embodiment of FIGS. 1–4.

What is claimed is:

1. A rotating spray head comprising:

a hollow inlet stem defining an axis and a hollow interior, said inlet stem having a distal end;

a body rotatably mounted to the distal end of the inlet stem for rotation about said axis, said body having a generally cylindrical outside surface, a distal end and a proximal end;

said inlet stem and said body defining a generally cylindrical reservoir therebetween;

said inlet stem having a fluid passageway fluidly coupling said hollow interior and said reservoir;

an offset side nozzle, formed through the generally cylindrical outside surface of the body and into the reservoir; and a plurality of end nozzles formed through each of the distal and proximal ends of the body and into the reservoir so a liquid directed through the inlet stem and into the reservoir passes through said end nozzles along flow paths passing generally through the axis;

whereby a liquid directed through the inlet stem and into said reservoir passes through said side nozzle along a flow path oriented offset to said axis to cause the body to rotate about the axis.

2. The spray head according to claim 1 further comprising first and second bearings mounted between said body and the inlet stem.

3. The spray head according to claim 1 comprising a plurality of said side nozzles positioned about said body at generally equal circumferential spacings.

4. A rotating spray head comprising:

a hollow inlet stem defining an axis and a hollow interior, said inlet stem having a distal end;

a body rotatable mounted to the distal end of the inlet stem for rotation about said axis, said body having a generally cylindrical outside surface, a distal end and a proximal end;

said inlet stem and said body defining a generally cylindrical reservoir therebetween;

said inlet stem having a fluid passageway fluidly coupling said hollow interior and said reservoir;

an offset side nozzle, formed through the generally cylindrical outside surface of the body and into the reservoir; and an end nozzle formed through each of the distal and proximal ends of the body and into the reservoir so a liquid directed through the inlet stem and into the reservoir passes through said end nozzles along flow paths passing generally through the axis, said distal and proximal ends of said body comprising generally U-shaped edges through which said end nozzles are formed;

whereby a liquid directed through the inlet stem and into said reservoir passes through said side nozzle along a flow path oriented offset to said axis to cause the body to rotate about the axis.

5. The spray head according to claim 4 wherein the distal and proximal ends of said body further comprise cylindrical stem mounting surfaces spaced apart from said generally U-shaped edges.

6. The spray head according to claim 5 further comprising first and second bearings mounted between said cylindrical stem mounting surfaces of said body and the inlet stem.

7. A rotating spray head comprising:

a hollow inlet stem defining an axis and a hollow interior, said inlet stem having a distal end;

a body rotatably mounted to the distal end of the inlet stem for rotation about said axis, said body having a generally cylindrical outside surface, a distal end and a proximal end;

the distal and proximal ends of said body comprising U-shaped edges and cylindrical stem mounting surfaces spaced apart from said generally U-shaped edges;

first and second bearings mounted between said cylindrical stem mounting surfaces of said body and the inlet stem;

said inlet stem and said body defining a generally cylindrical reservoir therebetween;

said inlet stem having a fluid passageway fluidly coupling said hollow interior and said reservoir;

an offset side nozzle, formed through the generally cylindrical outside surface of the body and into the reservoir;

an end nozzle formed through each of the U-shaped edges of the distal and proximal ends of the body and into the reservoir;

whereby a liquid directed through the inlet stem and into said reservoir passes through (a) said side nozzle along a flow path oriented offset to said axis to cause the body to rotate about the axis, and (b) said end nozzles along flow paths passing generally through the axis.

* * * * *